US008210137B2

(12) United States Patent
Kono et al.

(10) Patent No.: US 8,210,137 B2
(45) Date of Patent: Jul. 3, 2012

(54) LINK TYPE VARIABLE STROKE ENGINE

(75) Inventors: Shohei Kono, Wako (JP); Yoshikazu Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 492 days.

(21) Appl. No.: 12/469,806

(22) Filed: May 21, 2009

(65) Prior Publication Data

US 2009/0288643 A1 Nov. 26, 2009

(30) Foreign Application Priority Data

May 21, 2008 (JP) ..... 2008-133208

(51) Int. Cl.
*F02B 75/04* (2006.01)

(52) U.S. Cl. ..... 123/48 B; 123/196 R

(58) Field of Classification Search ..... 123/48 A, 123/48 AA, 48 B, 48 R, 78 A, 78 B, 196 R
See application file for complete search history.

(56) References Cited

U.S. PATENT DOCUMENTS

| | | | | |
|---|---|---|---|---|
| 4,422,414 | A * | 12/1983 | Moeller | 123/48 B |
| 4,517,931 | A * | 5/1985 | Nelson | 123/48 B |
| 4,784,093 | A * | 11/1988 | Pfeffer et al. | 123/78 B |
| 6,167,851 | B1 * | 1/2001 | Bowling | 123/48 B |
| 6,422,194 | B2 * | 7/2002 | Ito et al. | 123/196 R |
| 6,494,176 | B2 * | 12/2002 | Ito et al. | 123/196 R |
| 6,510,821 | B2 * | 1/2003 | Fujimoto et al. | 123/48 B |
| 7,185,615 | B2 * | 3/2007 | Sato et al. | 123/48 B |
| 7,357,111 | B2 * | 4/2008 | Maezuru et al. | 123/196 R |
| 2002/0020368 | A1 * | 2/2002 | Fujimoto et al. | 123/48 B |
| 2002/0043228 | A1 * | 4/2002 | Moteki | 123/78 E |
| 2003/0230257 | A1 * | 12/2003 | Watanabe | 123/48 B |
| 2004/0011307 | A1 | 1/2004 | Sato et al. | |

(Continued)

FOREIGN PATENT DOCUMENTS

EP 1359303 A2 11/2003

(Continued)

OTHER PUBLICATIONS

European Search Report dated Aug. 26, 2009, issued in corresponding European Patent Application No. 09160365.

(Continued)

*Primary Examiner* — Noah Kamen
*Assistant Examiner* — Long T Tran
(74) *Attorney, Agent, or Firm* — Westerman, Hattori, Daniels & Adrian, LLP

(57) ABSTRACT

In a link type variable stroke engine in which a piston, a crankshaft and an eccentric shaft are linked by a linking mechanism, an oil supply hole for supplying lubricating oil to a position between a connection tubular part of a sub connecting rod and a crank pin is provided in an upper portion of the connection tubular part at a position which is deviated from a direction of application of maximum load applied from the crank pin to an inner surface of the connection tubular part by maximum in-tube pressure, and which is immediately behind a point of application of the maximum load along a direction in which the crank pin rotates relative to the sub connecting rod. Accordingly, it is possible to prevent leak of oil from the oil supply hole and thereby reliably lubricating the position between the connection tubular part of the sub connecting rod and the crank pin by a splash lubrication system.

2 Claims, 6 Drawing Sheets

U.S. PATENT DOCUMENTS

| | | | | |
|---|---|---|---|---|
| 2005/0016488 | A1* | 1/2005 | Kawakubo et al. | 123/192.2 |
| 2006/0081211 | A1* | 4/2006 | Genter | 123/197.3 |

FOREIGN PATENT DOCUMENTS

| | | | |
|---|---|---|---|
| JP | 61-109913 | U | 7/1986 |
| JP | 62-105313 | U | 7/1987 |
| JP | 1-113114 | A | 7/1989 |
| JP | 1-157212 | U | 10/1989 |
| JP | 11-294444 | A | 10/1999 |
| JP | 2003-278567 | A | 10/2003 |
| JP | 2003-314211 | A | 11/2003 |
| JP | 2005-188719 | A | 7/2005 |

OTHER PUBLICATIONS

Japanese Office Action dated Dec. 7, 2011, issued in corresponding Japanese Patent Application No. 2008-133208.

Communication pursuant to Article 94(3) EPC dated Apr. 7, 2010, issued in corresponding European Application No. 09160365.

* cited by examiner

LINK TYPE VARIABLE STROKE ENGINE

BACKGROUND OF THE INVENTION

1. Field of the Invention

The present invention relates to a link type variable stroke engine, and especially relates to a link type variable stroke engine in which a piston slidably fitted to a cylinder block; a crankshaft rotatably supported at a crankcase; and a rotary shaft having an axis parallel with the crankshaft, being rotatably supported at the crankcase, and being provided with an eccentric shaft at an eccentric position, are linked by a linking mechanism, the linking mechanism including: a sub connecting rod having a connection tubular part into which a crank pin of the crankshaft is relatively rotatably fitted, and being rotatably connected with the crank pin; a main connecting rod connecting the sub connecting rod and the piston; and a swing rod connecting the sub connecting rod and the eccentric shaft, and oil scattered in the crankcase is guided to a position between the connection tubular part of the sub connecting rod and the crank pin.

2. Description of the Related Art

In conventional reciprocating engines, an oil supply hole is formed at a big end of a connecting rod to lubricate a position between the big end of the connecting rod and a crank pin by using oil scattered in a crankcase. Since load caused by explosion in a combustion chamber is applied to the big end of the connecting rod, the oil supply hole is formed in a position at the big end of the connecting rod, the position deviated from the direction of application of the load.

On the other hand, a link type variable stroke engine has already been known through Japanese Patent Application Laid-open No. 2003-278567. In the link type variable stroke engine, a piston, a crankshaft and an eccentric shaft provided to a rotary shaft parallel with the crankshaft are linked by a linking mechanism including a sub connecting rod, a main connecting rod and a swing rod. The sub connecting rod includes a connection tubular part into which a crank pin is relatively rotatably fitted, and thus is rotatably coupled with the crank pin. The main connecting rod connects the piston and the sub connecting rod. The swing rod connects the sub connecting rod and the eccentric shaft. Such a link type variable stroke engine also requires an oil supply hole formed at the connection tubular part of the sub connecting rod to lubricate a position between the connection tubular part of the sub connecting rod and the crank pin by a splash lubrication system using oil scattered in a crankcase.

Meanwhile, in the link type variable stroke engine, reaction force from the swing rod is applied to the sub connecting rod in addition to load by in-tube pressure acting thereon from the main connecting rod. Accordingly, the resultant force of the load by such in-tube pressure and the reaction force is applied to an inner surface of the connection tubular part of the sub connecting rod. Here, the direction of application of the resultant force is determined by the angle between the main connecting rod and the sub connecting rod, the magnitude of the force applied from the main connecting rod to the sub connecting rod, the angle between the sub connecting rod and the swing rod, the magnitude of the force applied from the swing rod to the sub connecting rod, and is not fixed in an operation cycle of the engine. If the oil supply hole is provided in a wrong position, oil leaks out from the oil supply hole under application of the maximum load by the maximum in-tube pressure, bringing serious effects on lubrication.

SUMMARY OF THE INVENTION

The present invention has been made in view of the above-described circumstances. It is an object of the present invention to provide a link type variable stroke engine capable of preventing leak of oil from an oil supply hole and thereby reliably lubricating a position between connection tubular part of a sub connecting rod and a crank pin by a splash lubrication system.

In order to achieve the object, according to a first feature of the present invention, there is provided a link type variable stroke engine in which a piston slidably fitted to a cylinder block; a crankshaft rotatably supported at a crankcase; and a rotary shaft having an axis parallel with the crankshaft, being rotatably supported at the crankcase, and being provided with an eccentric shaft at an eccentric position, are linked by a linking mechanism, the linking mechanism including: a sub connecting rod having a connection tubular part into which a crank pin of the crankshaft is relatively rotatably fitted, and being rotatably connected with the crank pin; a main connecting rod connecting the sub connecting rod and the piston; and a swing rod connecting the sub connecting rod and the eccentric shaft, and oil scattered in the crankcase is guided to a position between the connection tubular part of the sub connecting rod and the crank pin, wherein an oil supply hole for supplying lubricating oil to the position between the connection tubular part of the sub connecting rod and the crank pin is provided in an upper portion of the connection tubular part at a position which is deviated from a direction of application of maximum load applied from the crank pin to an inner surface of the connection tubular part by maximum in-tube pressure, and which is immediately behind a point of application of the maximum load along a direction in which the crank pin rotates relative to the sub connecting rod.

According to the first feature of the present invention, the oil supply hole is formed in the upper portion of the connection tubular part at a position which is deviated from the direction of application of the maximum load by the maximum in-tube pressure applied from the crank pin to the inner surface of the connection tubular part of the sub connecting rod and which is immediately behind the point of application of the maximum load along the relative rotation direction of the crank pin with respect to the sub connecting rod. Accordingly, even when the maximum load by the maximum in-tube pressure is applied to the connection tubular part of the sub connecting rod, leak of the oil from the oil supply hole is prevented, and consequently oil film shortage is prevented. Thus, efficient and reliable lubrication can be provided.

According to a second feature of the present invention, in addition to the first feature, the sub connecting rod includes: a pair of mutually facing plate parts integrally provided at right angles on an upper portion of the connection tubular part so as to sandwich, from opposite sides, end portions, on the sub connecting rod side, of the main connecting rod and the swing rod, respectively; and a connection plate part rising from an outer surface of the connection tubular part at a position below an opened end of the oil supply hole open to the outer surface of the connection tubular part, the connection plate part connecting both the facing plate parts, and an oil sump communicating with the oil supply hole and being opened upward is formed by the outer surface of the connection tubular part, both the facing plate parts and the connection plate part.

According to the second feature of the present invention, oil is collected in the oil sump. Thus, oil supply from the oil supply hole can be reliable.

The above description, other objects, characteristics and advantages of the present invention will be clear from detailed descriptions which will be provided for the preferred embodiments referring to the attached drawings.

BRIEF DESCRIPTION OF THE DRAWINGS

FIG. 1 is a longitudinal cross-sectional side view of an engine and a cross-sectional view taken along a line 1-1 in FIG. 2;

FIG. 2 is a cross-sectional view taken along a line 2-2 in FIG. 1;

FIG. 3 is a side view of a sub connecting rod;

FIG. 4 is a cross-sectional view taken along a line 4-4 in FIG. 3; and FIG. 5 is a cross-sectional view of a linking mechanism corresponding to FIG. 1 for explaining a load applied to the sub connecting rod.

DESCRIPTION OF THE PREFERRED EMBODIMENTS

A first embodiment of the present invention will be explained below based on FIGS. 1 to 5.

Figure 1:
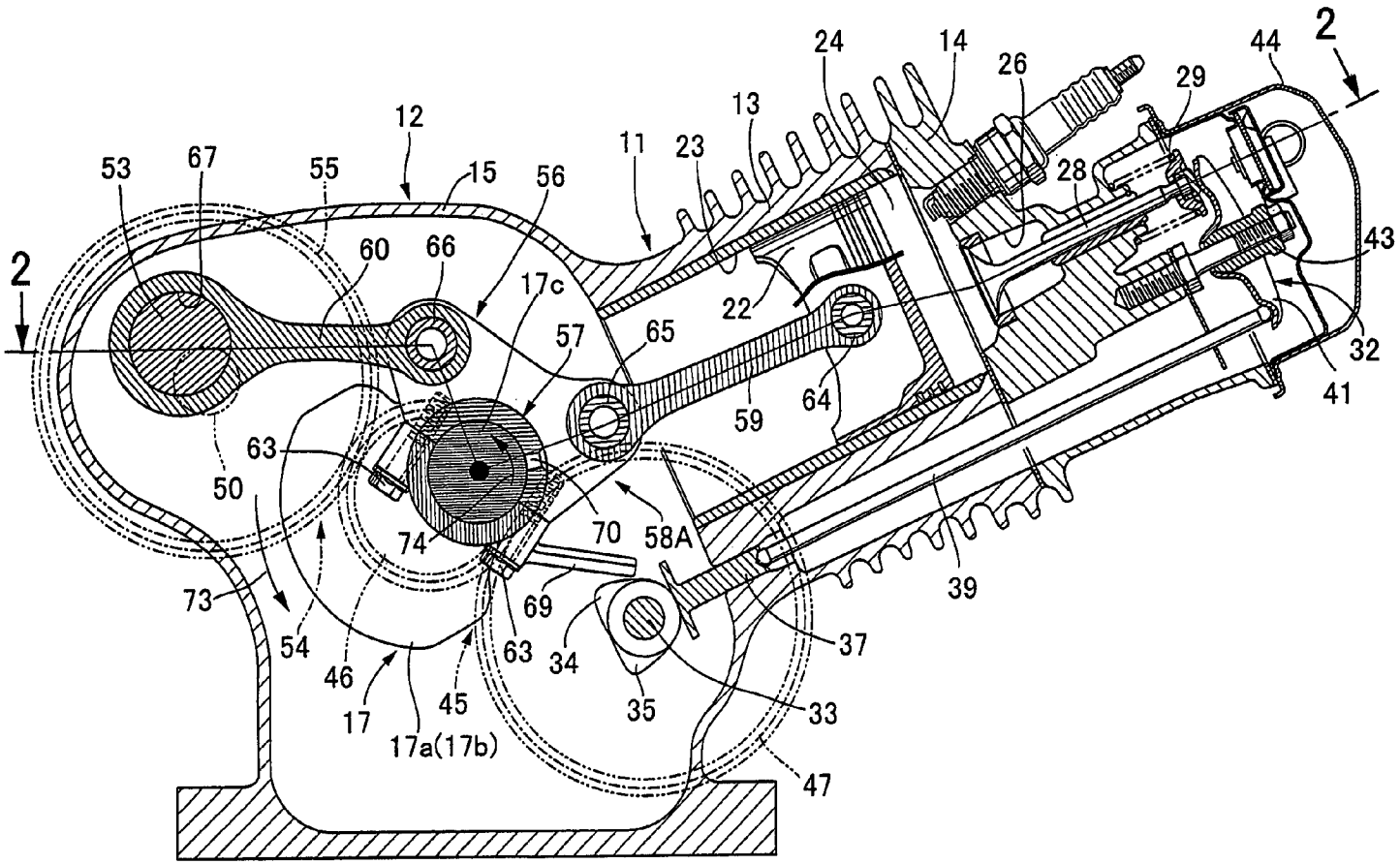
FIGS. 1 to 5 show a first embodiment of the present invention.
Figure 2:
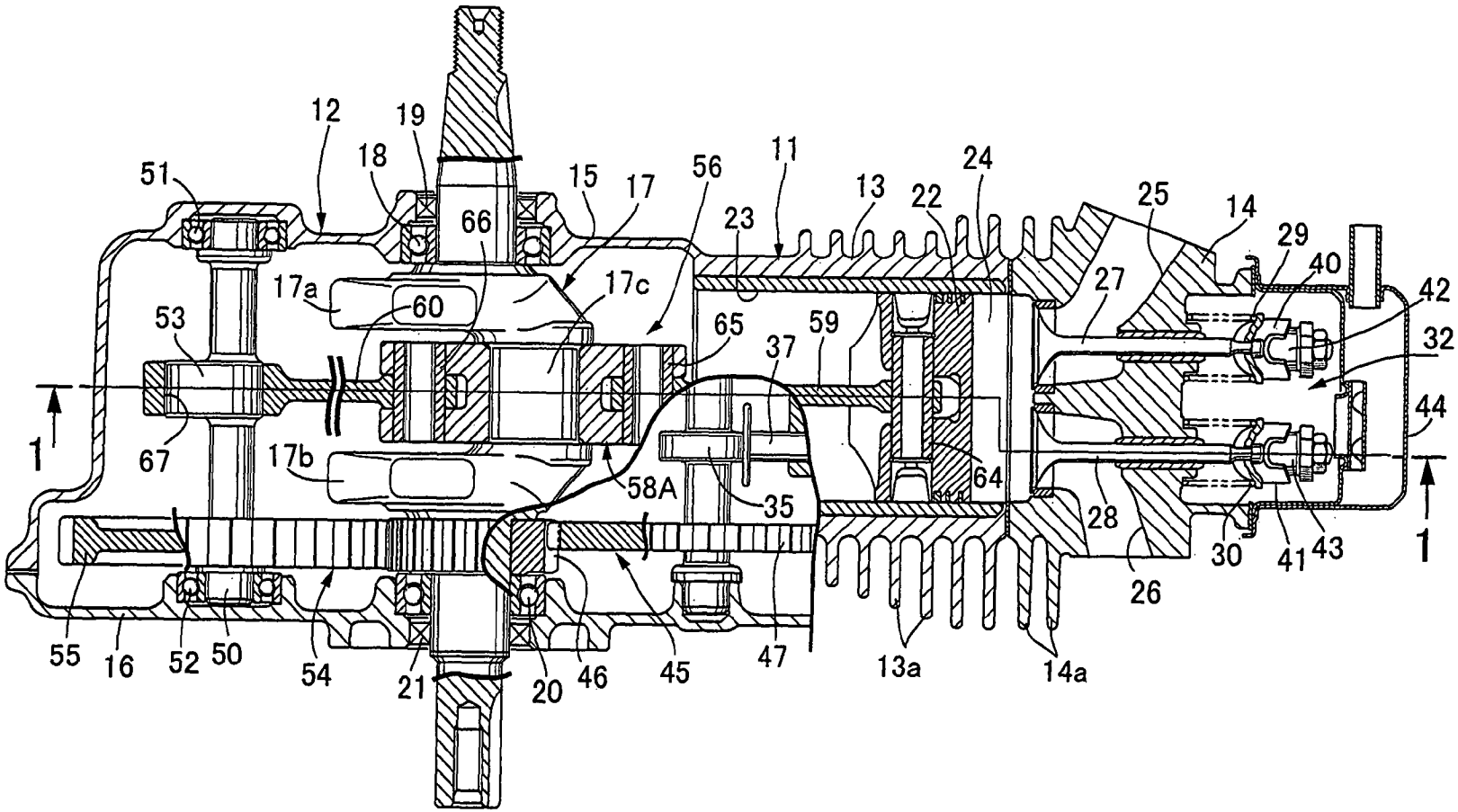

First, in FIG. 1 and FIG. 2, this link type variable stroke engine is an air-cooled single cylinder engine, which is used for working machines and the like, for example. An engine body 11 includes: a crankcase 12; a cylinder block 13 protruding in upwardly tilting manner from one side surface of the crankcase 12; and a cylinder head 14 joined to a head portion of the cylinder block 13. A large number of air-cooling fins 13*a* and 14*a* are provided on outer side surfaces of the cylinder block 13 and the cylinder head 14.

The crankcase 12 comprises: a case main body 15 formed integrally with the cylinder block 13 by molding and opened at one side; and a side cover 16 joined to the opened end of the case main body 15. A crankshaft 17 is rotatably supported in the crankcase 12. The crankshaft 17 integrally has a pair of counterweights 17*a* and 17*b*, as well as a crank pin 17*c* which connects between the counter weights 17*a* and 17*b*. Accordingly, both end portions of the crankshaft 17 rotatably penetrate the case main body 15 and the side cover 16 of the crankcase 12 and protrude outwardly. A ball bearing 18 and an annular sealing member 19 are disposed between the crankshaft 17 and the case main body 15, the sealing member 19 disposed on the outer side of the ball bearing 18, and a ball bearing 20 and an annular sealing member 21 are disposed between the crankshaft 17 and the side cover 16, the sealing member 21 disposed on the outer side of the ball bearing 20.

A cylinder bore 23 is formed in the cylinder block 13. A piston 22 is slidably fitted in the cylinder bore 23. A combustion chamber 24 is formed between the cylinder block 13 and the cylinder head 14, and a top portion of the piston 22 faces the combustion chamber 24. An intake port 25 and an exhaust port 26, both communicating with the combustion chamber 24, are formed in the cylinder head 14. In addition, an intake valve 27 for opening and closing the passage between the intake port 25 and the combustion chamber 24 as well as an exhaust valve 28 for opening and closing the passage between the exhaust port 26 and the combustion chamber 24 are disposed in the cylinder head 14 so as to be capable of performing the opening and closing operations. The intake valve 27 and the exhaust valve 28 are urged in a valve-closing direction by valve springs 29 and 30, respectively.

A valve operating mechanism 32 opening and closing the intake valve 27 and the exhaust valve 28 includes: a cam shaft 33 including an intake cam 34 and an exhaust cam 35 and rotatably supported at the crankcase 12; an intake tappet (not illustrated) supported at the cylinder block 13 so that the intake cam 34 causes the intake tappet to slide up and down following motion of the intake cam 34; an exhaust tappet 37 supported at the cylinder block 13 so that the exhaust cam 35 causes the exhaust tappet 37 to slide up and down following motion of the exhaust cam 35; an intake push rod (not illustrated) continuously connected, at its lower end portion, with an upper end portion of the intake tappet and extending in the up-down direction; an exhaust push rod 39 continuously connected, at its lower end portion, with an upper end portion of the exhaust tappet and extending in the up-down direction; an intake rocker arm 40 swingably supported by a spherical supporting part 42 fixed to the cylinder head 14; and an exhaust rocker arm 41 swingably supported by a spherical supporting part 43 fixed to the cylinder head 14. One end portion of the intake rocker arm 40 is in contact with an upper end of the intake push rod, whereas one end portion of the exhaust rocker arm 41 is in contact with an upper end of the exhaust push rod 39. The other end portions of the intake rocker arm 40 and the exhaust rocker arm 41 are in contact respectively with head portions of the intake valve 27 and the exhaust valve 28.

The spherical supporting parts 42 and 43 and the intake and exhaust rocker arms 40 and 41 of the valve operating mechanism 32 are covered with a head cover 44, and the head cover 44 is connected with the cylinder head 14.

The cam shaft 33 has an axis parallel with the crankshaft 17. Between the camshaft 33 and the crankshaft 17, first timing transmitting means 45 is provided which transmits the rotation power of the crankshaft 17 at a speed reduction ratio of 1/2. The first timing transmitting means 45 includes: a driving gear 46 fixed to the crankshaft 17; and a first driven gear 47 provided to the cam shaft 33.

Opposite end portions of a rotary shaft 50 are rotatably supported at the case main body 15 and the side cover 16 of the crankcase 12 with ball bearings 51 and 52, respectively, the rotary shaft 50 having an axis parallel with the crankshaft 17 while having a rotation axis above an axis of the crankshaft 17. Between the rotary shaft 50 and the crankshaft 17, second timing transmitting means 54 is disposed which reduces the rotation power of the crankshaft 17 at a speed reduction ratio of 1/2 and then transmits the rotation power to the rotary shaft 50. The second timing transmitting means 54 comprises the driving gear 46 fixed to the crankshaft 17 and a second driven gear 55 integrally provided to the rotary shaft 50 so as to mesh with the driving gear 46.

An eccentric shaft 53 is provided integrally with the rotary shaft 50 at a position corresponding to a portion between the pair of counterweights 17*a* and 17*b* of the crankshaft 17. The eccentric shaft 53 has its axis at a position eccentric with respect to the axis of the rotary shaft 50. The eccentric shaft 53, the piston 22 and the crankshaft 17 are linked by a linking mechanism 56.

The linking mechanism 56 includes: a sub connecting rod 58A having a connection tubular part 57 into which the crank pin 17*c* of the crankshaft 17 is relatively rotatably fitted, and being rotatably coupled with the crank pin 17*c*; a main connecting rod 59 connecting the sub connecting rod 58A and the piston 22; and a swing rod 60 which connects the sub connecting rod 58A and the eccentric shaft 53.

Figure 3:
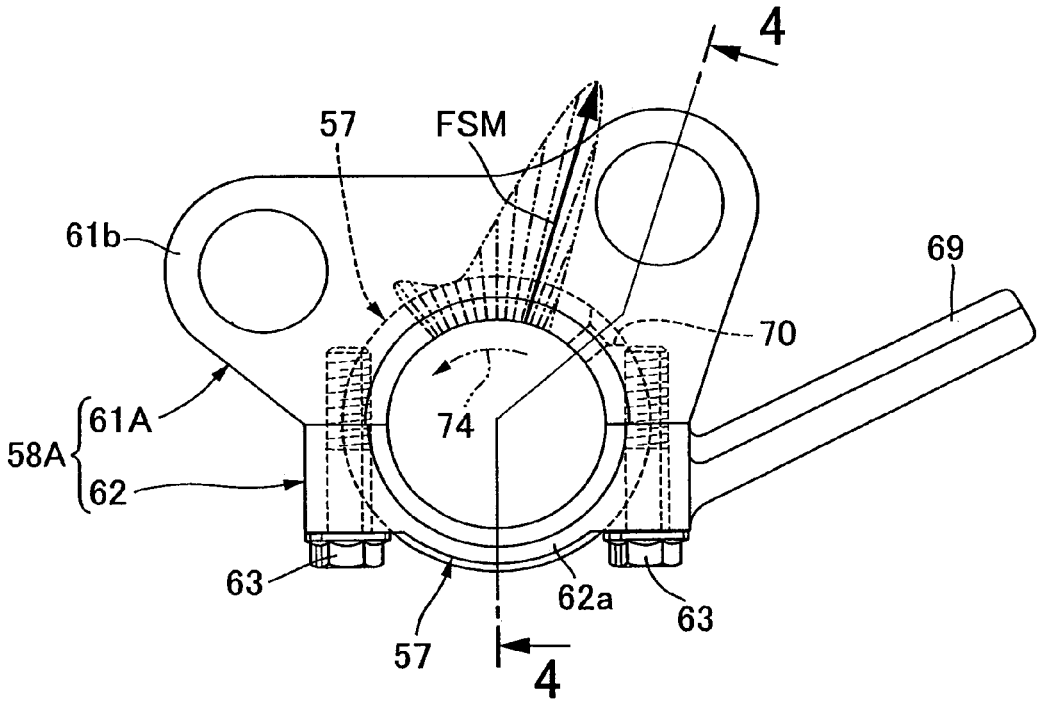
Figure 4:
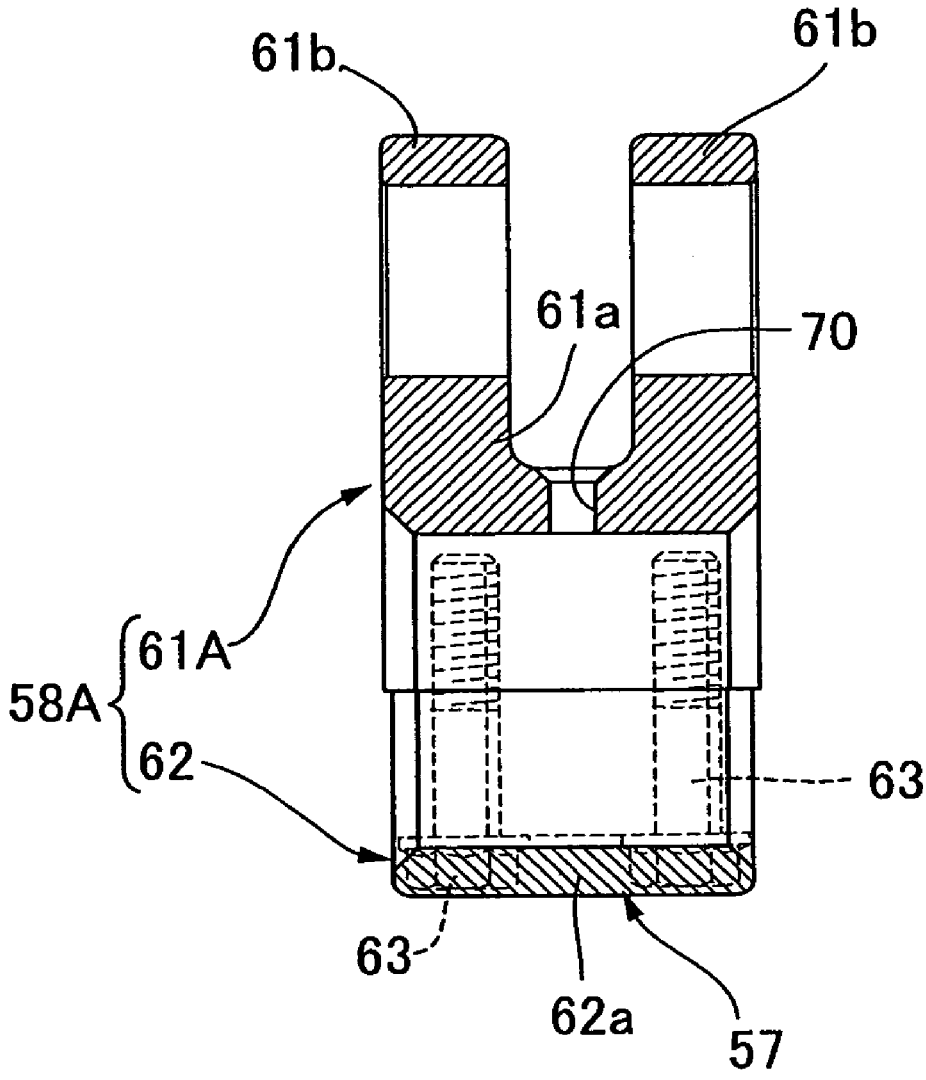

Referring to FIG. 3 and FIG. 4 in combination, the sub connecting rod 58A comprises: a sub connecting rod main body 61A; and a crank cap 62 fastened to the sub connecting rod main body 61A by using multiple, for example, four, bolts 63 and 63.

The sub connecting rod main body 61A includes: a semicylinder 61*a* which has a cross section in a semicircular shape and into which a substantially half of the crank pin 17*c* is fitted; and a pair of facing plate parts 61*b* and 61*b* integrally connected respectively with two axial-direction ends of the semicylinder 61*a* at right angles, extending upward, and facing each other. The crank cap 62 includes a semicylinder 62*a* which has a cross section in a semicircular shape and into which the residual substantially half of the crank pin 17*c* is fitted. The sub connecting rod 58A is formed by fastening the crank cap 62 to the sub connecting rod main body 61A, and, in this state, the two semicylinders 61*a* and 62*a* form the connection tubular part 57 into which the crank pin 17*c* of the crankshaft 17 is relatively rotatably fitted, while the two facing plate parts 61*b* and 61*b* are integrally connected with the upper portion of the connection tubular part 57 at right angles and extend upward from the connection tubular part 57.

One end portion of the main connecting rod 59 is connected with the piston 22 by using a piston pin 64, and the other end portion of the main connecting rod 59 is sandwiched between the two facing plate parts 61*b* and 61*b* of the sub connecting rod 58A and rotatably connected with the two facing plate parts 61*b* and 61*b* by using a connecting rod pin 65.

One end portion of the swing rod 60 is sandwiched between the two facing plate parts 61*b* and 61*b* of the sub connecting rod 58A at a position deviated from the connecting rod pin 65, and is rotatably connected with the two facing plate parts 61*b* and 61*b* by using a swing pin 66. At the other end portion of the swing rod 60, a circular connection hole 67 into which the eccentric shaft 53 is relatively rotatably fitted is formed.

When the rotary shaft 50 is rotated at a speed reduction ratio of 1/2 along with rotation of the crankshaft 17 and the eccentric shaft 53 thereby rotates about the rotation axis of the rotary shaft 50, the linking mechanism 56 operates, for example, in a manner that the stroke of the piston 22 in the expansion stroke becomes larger than that in the compression stroke. Thus, a higher expansion work is achieved with the same amount of intake of the air-fuel mixture, so that the cycle thermal efficiency can be improved.

An oil dipper 69 extending to a side is integrally formed on the crank cap 62 of the sub connecting rod 58A. Upon rotation of the crank pin 17*c* about the axis of the crankshaft 17, the oil dipper 69 stirs and scoops up oil stored in a lower portion of the crankcase 12, thereby the oil droplets are scattered in the crankcase 12. A portion between the connection tubular part 57 and the crank pin 17*c* are lubricated by a splash lubrication system using oil droplets in the crankcase 12, and an oil supply hole 70 is formed in an upper portion of the connection tubular part 57 of the sub connecting rod 58A to guide the oil droplets to a position between the connection tubular part 57 and the crank pin 17*c*.

Figure 5:
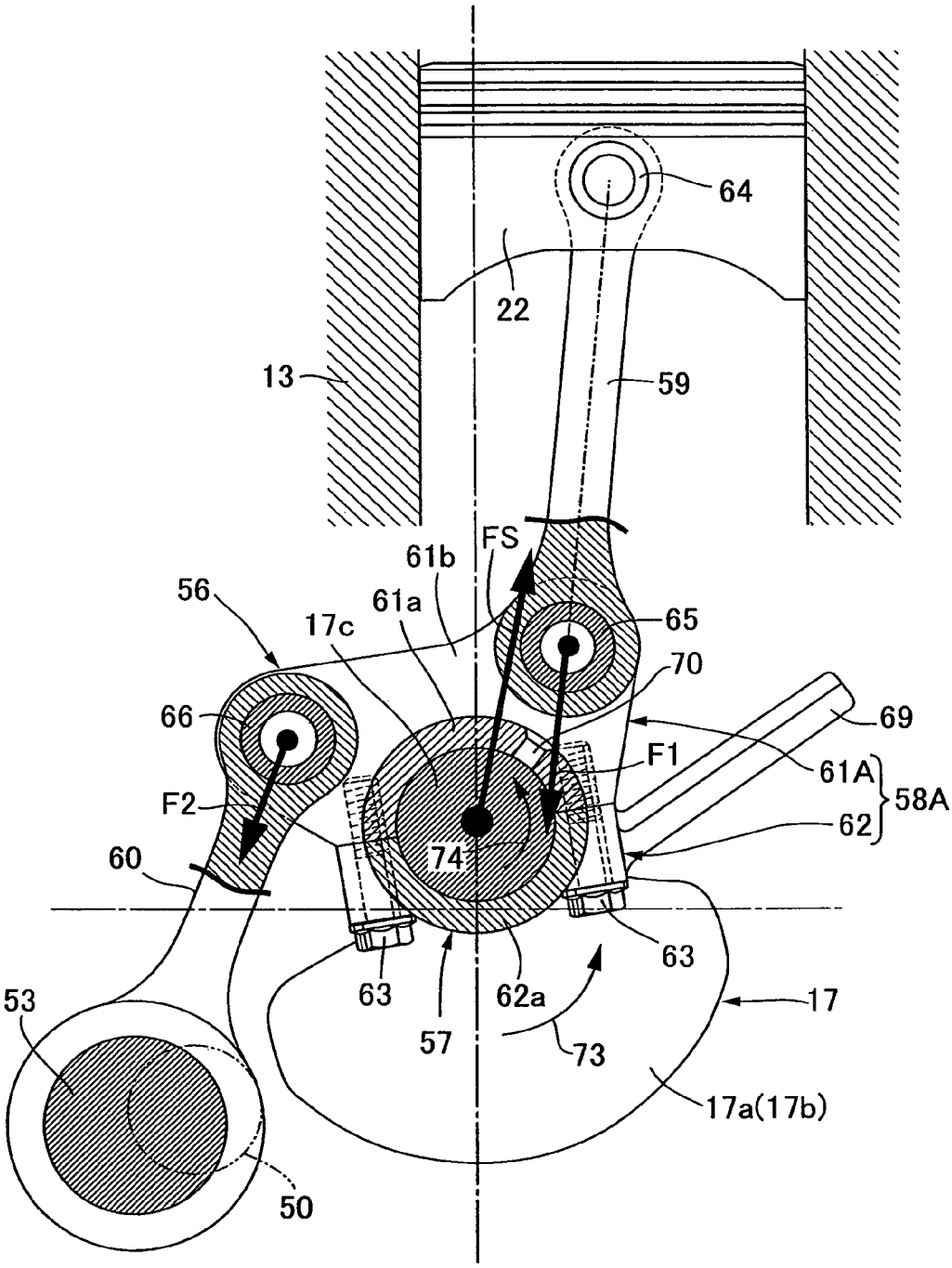

Now, in the link type variable stroke engine having the above-described configuration, reaction force F2 is applied from the swing rod 60 to the sub connecting rod 58A in addition to load F1 by in-tube pressure from the main connecting rod 59 to the sub connecting rod 58A, as shown in FIG. 5. Accordingly, such resultant force FS of the load F1 by in-tube pressure and the reaction force F2 is applied from the crank pin 17*c* to an inner surface of the connection tubular part 57 of the sub connecting rod 58A.

Here, the direction of application of the resultant force FS is determined by the angle between the main connecting rod 59 and the sub connecting rod 58A, the magnitude of the force F1 applied from the main connecting rod 59 to the sub connecting rod 58A, the angle between the sub connecting rod 58A and the swing rod 60, the magnitude of the force F2 applied from the swing rod 60 to the sub connecting rod 58A. Accordingly, the direction of application of the resultant force FS is not fixed in an operation cycle of the engine, and changes as indicated by chain lines in FIG. 3.

According to the present invention, the oil supply hole 70 is formed in a position deviated from a direction of application of a maximum load FSM (see FIG. 3) by the maximum in-tube pressure applied from the crank pin 17*c* to the inner surface of the connection tubular part 57. Upon rotation of the crank pin 17*c* in the direction indicated by an arrow 73 in FIG. 1 in response to reciprocating sliding of the piston 22 in the cylinder bore 23, the crank pin 17*c* relatively rotates, with respect to the sub connecting rod 58A, in the relative rotation direction indicated by an arrow 74. The oil supply hole 70 is formed in the upper portion of the connection tubular part 57 so as to be located immediately behind the point of application of the maximum load FSM along the relative rotation direction 74.

Next, operations of this embodiment will be described. The oil supply hole 70 for supplying lubricating oil to a position between the crank pin 17*c* and the connection tubular part 57 of the sub connecting rod 58A in the linking mechanism 56 is formed in the upper portion of the connection tubular part 57. The oil supply hole 70 is set in a position which is deviated from the direction of application of the maximum load FSM applied from the crank pin 17*c* to the inner surface of the connection tubular part 57 by the maximum in-tube pressure and which is immediately behind the point of application of the maximum load FSM along the relative rotation direction 74 of the crank pin 17*c* with respect to the sub connecting rod 58A.

Accordingly, even when the maximum load FSM is applied to the connection tubular part 57 of the sub connecting rod 58A by the maximum in-tube pressure, leak of oil from the oil supply hole 70 can be prevented, and consequently occurring of oil film shortage can be prevented. Thus, efficient and reliable lubrication can be provided.

Figure 6:
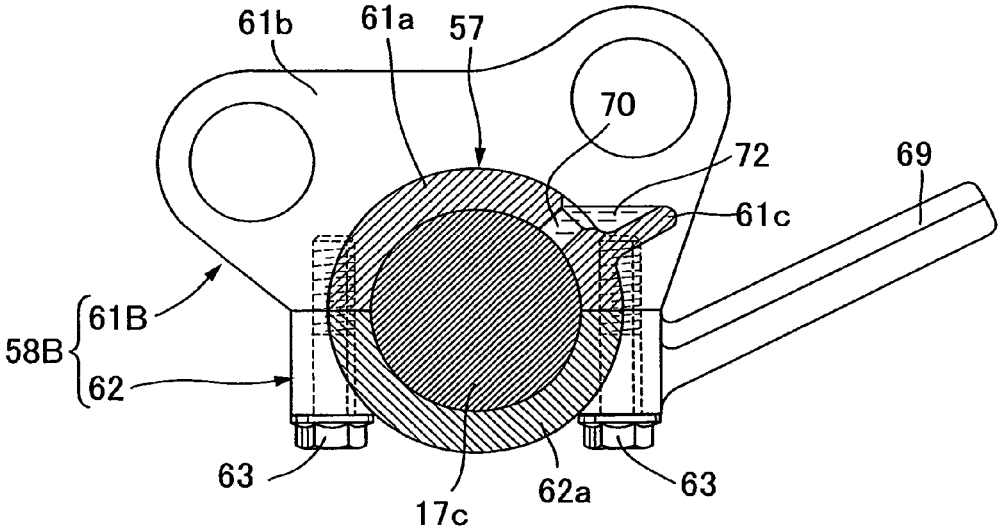
FIG. 6 is a longitudinal cross-sectional view of a sub connecting rod of a second embodiment.

FIG. 6 shows a second embodiment of the present invention. The components corresponding to those of the first embodiment are simply denoted by the same reference numerals in the drawings and detailed descriptions thereof are omitted.

A sub connecting rod 58B comprises: a sub connecting rod main body 61B; and a crank cap 62 fastened to the sub connecting rod main body 61B by using multiple, for example, four, bolts 63 and 63.

The sub connecting rod main body 61B includes: a semicylinder 61*a* which has a cross section in a semicircular shape and into which a substantially half of a crank pin 17*c* is fitted; and a pair of facing plate parts 61*b* and 61*b* integrally connected respectively with two axial-direction ends of the semicylinder 61*a* at right angles, extending upward, and facing each other. The crank cap 62 includes a semicylinder 62*a* which has a cross section in a semicircular shape and into which the residual substantially half of the crank pin 17*c* is fitted. The sub connecting rod 58B is formed by fastening the crank cap 62 to the sub connecting rod main body 61B, and, in this state, the two semicylinders 61*a* and 62*a* form a connection tubular part 57 into which the crank pin 17*c* of the crankshaft 17 is relatively rotatably fitted.

Moreover, the sub connecting rod main body 61B of the sub connecting rod 58B includes a connection plate part 61*c* formed integrally thereon and rising from an outer surface of the connection tubular part 57 at a position below the open end of the oil supply hole 70 at the outer surface of the connection tubular part 57 to connect the pair of facing plate parts 61*b*. An oil sump 72 communicating with the oil supply hole 70 and opened upward is formed by the outer surface of the connection tubular part 57, the two facing plate parts 61*b* and the connection plate part 61*c*.

According to the second embodiment, the same effects as those of the first embodiment can be provided, and also, since oil can be collected in the oil sump 72, oil supply from the oil supply hole 70 can be reliable.

Embodiments of the present invention are explained above, but the present invention is not limited to the above-mentioned embodiments and may be modified in a variety of ways as long as the modifications do not depart from its gist.

The invention claimed is:

1. A link type variable stroke engine in which a piston slidably fitted to a cylinder block; a crankshaft rotatably supported at a crankcase; and a rotary shaft having an axis parallel with the crankshaft, being rotatably supported at the crankcase, and being provided with an eccentric shaft at an eccentric position, are linked by a linking mechanism, the linking mechanism including: a sub connecting rod having a connection tubular part into which a crank pin of the crankshaft is relatively rotatably fitted, and being rotatably connected with the crank pin; a main connecting rod connecting the sub connecting rod and the piston; and a swing rod connecting the sub connecting rod and the eccentric shaft, and oil scattered in the crankcase is guided to a position between the connection tubular part of the sub connecting rod and the crank pin, wherein an oil supply hole for supplying lubricating oil to the position between the connection tubular part of the sub connecting rod and the crank pin is provided in an upper portion of the connection tubular part at a position which is deviated from a direction of application of maximum load applied from the crank pin to an inner surface of the connection tubular part by maximum in-tube pressure, and which is immediately behind a point of application of the maximum load along a direction in which the crank pin rotates relative to the sub connecting rod.

2. The link type variable stroke engine according to claim 1, wherein the sub connecting rod includes: a pair of mutually facing plate parts integrally provided at right angles on an upper portion of the connection tubular part so as to sandwich, from opposite sides, end portions, on the sub connecting rod side, of the main connecting rod and the swing rod, respectively; and a connection plate part rising from an outer surface of the connection tubular part at a position below an opened end of the oil supply hole open to the outer surface of the connection tubular part, the connection plate part connecting both the facing plate parts, and an oil sump communicating with the oil supply hole and being opened upward is formed by the outer surface of the connection tubular part, both the facing plate parts and the connection plate part.

* * * * *